US009824787B2

(12) United States Patent
Miller et al.

(10) Patent No.: US 9,824,787 B2
(45) **Date of Patent: *Nov. 21, 2017**

(54) SPARK GAP X-RAY SOURCE

(71) Applicant: Moxtek, Inc., Orem, UT (US)

(72) Inventors: Eric Miller, Provo, UT (US); Bill Hansen, Manteca, CA (US)

(73) Assignee: Moxtek, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 15/618,458

(22) Filed: Jun. 9, 2017

(65) Prior Publication Data

US 2017/0278588 A1 Sep. 28, 2017

Related U.S. Application Data

(63) Continuation of application No. 14/739,712, filed on Jun. 15, 2015.

(60) Provisional application No. 62/028,113, filed on Jul. 23, 2014, provisional application No. 62/079,295, filed on Nov. 13, 2014.

(51) Int. Cl.

| | |
|---|---|
| ***G21K 5/08*** | (2006.01) |
| ***H01J 35/06*** | (2006.01) |
| ***H01J 35/18*** | (2006.01) |
| ***G21K 5/10*** | (2006.01) |
| ***H01J 35/08*** | (2006.01) |
| ***H05F 3/04*** | (2006.01) |

(52) U.S. Cl.

CPC ..... *G21K 5/08* (2013.01); *G21K 5/10* (2013.01); *H01J 35/06* (2013.01); *H01J 35/08* (2013.01); *H01J 35/18* (2013.01); *H05F 3/04* (2013.01); *H01J 2235/086* (2013.01); *H01J 2235/087* (2013.01)

(58) Field of Classification Search

CPC .. G21K 5/10; H01J 35/06; H01J 35/08; H01J 2235/086; H01J 2235/087; H05F 3/04

USPC ..... 378/119–144

See application file for complete search history.

(56) References Cited

U.S. PATENT DOCUMENTS

| | | | |
|---|---|---|---|
| 3,970,884 | A | 7/1976 | Golden |
| 4,119,234 | A | 10/1978 | Kotschak et al. |
| 5,469,490 | A | 11/1995 | Golden et al. |
| 5,615,244 | A | 3/1997 | Dykster et al. |
| 5,651,045 | A | 7/1997 | Pouvesle et al. |

(Continued)

FOREIGN PATENT DOCUMENTS

| | | | |
|---|---|---|---|
| EP | 1089317 | A1 | 4/2001 |
| JP | 2000/267106 | A | 9/2000 |

(Continued)

*Primary Examiner* — Courtney Thomas

(74) *Attorney, Agent, or Firm* — Thorpe, North & Western, LLP

(57) ABSTRACT

In one embodiment, the invention includes an x-ray source having a cathode with an elongated blade oriented substantially transverse with respect to a longitudinal axis of the cathode. The blade can be pointed towards an anode. In another embodiment, the invention includes an x-ray source having a window with an annular-shape, forming a hollow-ring. A convex portion of a half-ball-shape of an anode can extend into a hollow of the annular-shape of the window. In another embodiment, the invention includes an x-ray source having an anode with a dome shape having a concave side facing the electron emitter.

20 Claims, 15 Drawing Sheets

(56) References Cited

U.S. PATENT DOCUMENTS

| | | | | |
|---|---|---|---|---|
| 6,205,200 | B1 | 3/2001 | Boyer et al. | |
| 6,353,658 | B1 * | 3/2002 | Trebes | A61N 5/1001 378/119 |
| 6,563,110 | B1 | 5/2003 | Len | |
| 6,570,959 | B1 | 5/2003 | Kuzniar | |
| 9,240,303 | B2 | 1/2016 | Barnum et al. | |
| 2004/0008818 | A1 | 1/2004 | Rangsten et al. | |
| 2005/0031083 | A1 * | 2/2005 | Kindlein | A61N 5/1001 378/136 |
| 2006/0280290 | A1 | 12/2006 | Matsumura et al. | |
| 2007/0165784 | A1 | 7/2007 | Nakanishi et al. | |
| 2007/0188970 | A1 | 8/2007 | Inaba et al. | |
| 2010/0074410 | A1 | 3/2010 | Ito et al. | |
| 2010/0232571 | A1 | 9/2010 | Pietig et al. | |
| 2013/0308756 | A1 | 11/2013 | Bogan et al. | |
| 2015/0092924 | A1 | 4/2015 | Yun et al. | |

FOREIGN PATENT DOCUMENTS

| | | | |
|---|---|---|---|
| JP | 2002/352997 | A | 12/2002 |
| JP | 2006/049390 | A | 2/2006 |
| JP | 2014/514718 | A | 6/2014 |
| JP | 2014/143168 | A | 8/2014 |
| KR | 10-2004-0095587 | A | 11/2004 |
| KR | 10-2007-0071298 | A | 7/2007 |
| KR | 10-2013-0018540 | A | 2/2013 |

* cited by examiner

SPARK GAP X-RAY SOURCE

CLAIM OF PRIORITY

This is a continuation of U.S. patent application Ser. No. 14/739,712, filed on Jun. 15, 2015, which claims priority to U.S. Provisional Patent Application Nos. 62/028,113, filed on Jul. 23, 2014, and 62/079,295, filed on Nov. 13, 2014, which are incorporated herein by reference in their entirety.

FIELD OF THE INVENTION

The present application is related generally to x-ray sources.

BACKGROUND

X-ray sources have many uses, such as for example, imaging, x-ray crystallography, electrostatic dissipation, electrostatic precipitation, and x-ray fluorescence.

Some uses can be limited due to the high cost of the x-ray source. It would be beneficial to reduce the cost of x-ray sources while maintaining their functionality.

For some applications, a narrow beam of x-rays is desired. Other applications, however, require a wide angle beam to emit the x-rays over a large area.

X-ray tubes can be fragile, but are sometimes used in rough environments, so it can be important to protect x-ray sources from damage due to bumping against other devices or from chemical corrosion. It would be beneficial to make a more robust x-ray source.

One fragile x-ray tube component is the x-ray window through which x-rays are transmitted. If a protective structure is placed in front of or surrounds the window then it can be important, especially for low energy x-ray sources, to select materials for the protective structure that have high x-ray transmissivity in order to avoid excessive x-ray attenuation.

SUMMARY

It has been recognized that it would be advantageous to: (1) reduce the cost of x-ray sources while maintaining their functionality, (2) provide a more robust x-ray source, and/or (3) provide an x-ray source with a wide angle beam of x-rays. The present invention is directed to various embodiments of x-ray sources, and methods of using such x-ray sources, that satisfy these needs. Each embodiment or method may satisfy one, some, or all of these needs.

In one embodiment, the x-ray source can comprise a cathode with a an elongated blade pointed towards an anode. There can be a gap between the blade and the anode.

In another embodiment, the x-ray source can include a window having an annular-shape, forming a hollow-ring. The window can be electrically-conductive and substantially transmissive to x-rays. The x-ray source can also include a half-ball-shaped anode.

In another embodiment, the x-ray source can include an anode having a dome shape with a concave side facing an electron emitter, the concave side including a target material configured to emit x-rays in response to impinging electrons from the electron emitter.

DEFINITIONS

Figure 1:
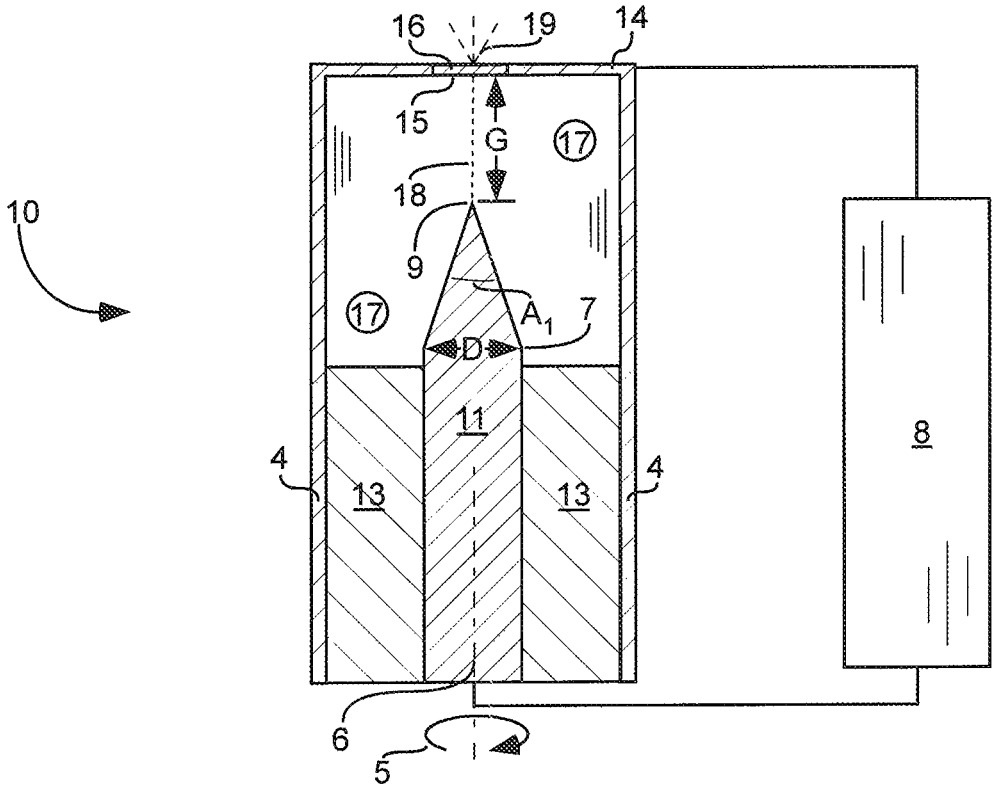
FIG. 1 is a schematic cross-sectional side view of an end-window, transmission-target x-ray source 10 having a cathode 11 with a pointed end 9, in accordance with an embodiment of the present invention.

As used herein, the term "half-ball-shape" means that the shape includes a portion that is curved like approximately half of a ball, but not necessarily a shape with all points equidistant from the center. A half-ball-shape can be hollow or solid, as some balls are hollow (e.g. tennis balls) and some balls are solid (e.g. baseball). The entire shape can be "half-ball-shaped" or, in addition to the "half-ball-shaped" portion, there can be another portion having a shape (e.g. a matching half-ball shape, a cube-shape, etc.).

As used herein, the term "bowl-shaped" means that the shape includes a convex portion (bulging outwards but not necessarily rounded) and a concave portion (extending inwards but not necessarily rounded). For example, a "bowl-shaped" structure can have a triangular, square, or rounded cross-sectional profile.

As used herein, the term "pointed end" means a tapering end such as on a dagger, a needle, or an end of a ball-point pen.

As used herein, "evacuated" or "substantially evacuated" means a vacuum such as is typically used for x-ray tubes.

DETAILED DESCRIPTION

As illustrated in FIGS. 1-6, x-ray sources 10, 20, 30, 40, 50, and 60 are shown comprising an enclosure 4 with an internal cavity 17. An anode 14 and a cathode 11 can be attached to the enclosure 4. The anode 14 and the cathode 11 can be electrically-conductive. The anode 14 and the cathode 11 can be spaced apart from each other and can be electrically insulated from each other. The cathode 11 and the anode 14 can be electrically insulated from each other by an electrically-insulative, solid material 13 and/or by the cavity 17. The cathode 11 can have a pointed end 9 disposed within the cavity 17 and pointed towards the anode 14. There can be a gap G between the pointed end 9 and the anode 14.

A power supply 8 can be electrically connected to the anode 14 and to the cathode 11. In one embodiment, the power supply 8 can provide pulses of voltage between the anode 14 and the cathode 11. These pulses can have a magnitude sufficiently high to cause periodic arcs between the cathode 11 and the anode 14. Electrons 18 in the arc, impinging on the anode 14, can cause an emission of x-rays 19 outward from the x-ray source. Examples of voltage differentials between the anode 14 and the cathode 11, at the time of the arcs, include between 1 kilovolt and 20 kilovolts in one aspect or between 10 kilovolts and 200 kilovolts in another aspect. For example, the periodic pulses of voltage can be created by an induction coil.

A size of the gap G, an angle $A_1$ of the pointed end 9 of the cathode 11, and a diameter D of the cathode 11 at a location where the cathode 11 begins to taper towards the pointed end 9, can be modified for desired electric field gradients and desired voltage at which arcing occurs. For example, the internal angle $A_1$ of the pointed end 9, can be less than 90° in one aspect, between 60° and 90° in another aspect, or between 30° and 65° in another aspect. The diameter D of the cathode 11 can be less than 0.5 millimeters in one aspect. The gap G can be between 3-5 millimeters in one aspect. In one embodiment, the pointed end 9 can have an angle of sharpness and the gap G can be sized for a voltage gradient at the pointed end 9 of at least 500 volts/mil just prior to arcing.

An electrically-conductive window 16 can be associated with and can be connected to the anode 14. The window 16 can be electrically connected to the anode 14. The window 16 can be substantially transmissive to x-rays 19. The window 16 can include some or all of the properties (e.g. low deflection, high x-ray transmissivity, low visible and infrared light transmissivity) of the x-ray window described in U.S. patent application Ser. No. 14/597,955, filed on Jan. 15, 2015, which is incorporated herein by reference in its entirety. The window 16 can form at least part of a wall of the enclosure 4 and can separate at least a portion of the cavity 17 from an exterior of the enclosure 4.

The cavity can have a high vacuum, a low vacuum, or can be at or near atmospheric pressure, depending on the application. A benefit of a high vacuum in the cavity 17 is that electrons 18 emitted from the cathode 11 towards a target material 15 on the anode 14 or window 16 are not, or are minimally, impeded by the gas. Evacuated x-ray tubes can be more efficient and can have less variation in output. On the other hand, evacuated x-ray tubes can have a substantially higher manufacture cost.

Some applications might not require the high efficiency with use of an evacuated x-ray tube and can use a lower cost x-ray tube with a relatively higher internal pressure. A power supply 8 that is pulsed can provide, sufficient voltage for pulses of electrons 18 from the cathode 11 to the anode 14.

The x-ray sources described herein can be evacuated or can have a gas disposed in the cavity 17. The gas in the cavity 17 can have a pressure of at least 0.0001 Torr in one aspect or a pressure of between 1 Torr and 900 Torr in another aspect. The gas can comprise a low atomic number element (e.g. $Z<11$), such as nitrogen or helium for example. The gas can comprise at least 85% helium. Helium can be beneficial due to its relatively low cost, high thermal conductivity, low atomic number, and because it is inert. For simplicity of manufacture, the gas can be or can comprise air. The cavity 17 can be hermetically sealed to maintain the desired pressure and type of gas in the cavity 17. Reduced vacuum requirements can allow the x-ray source to be more robust because minor leaks or outgassing might have a negligible effect on performance.

Figure 2:
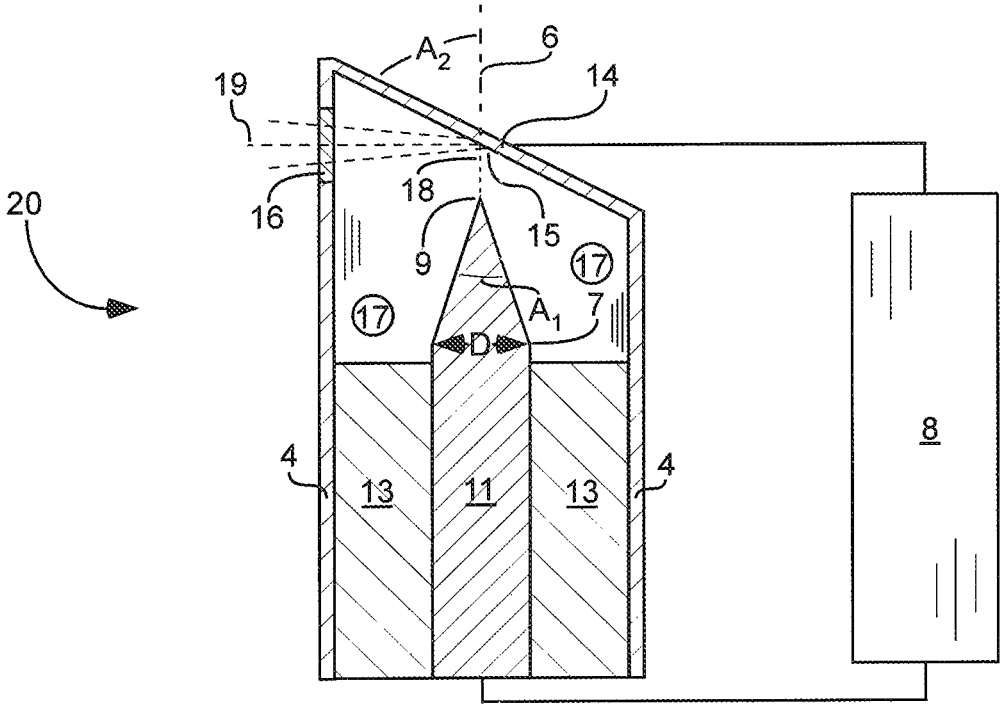
FIG. 2 is a schematic cross-sectional side view of a side-window x-ray source 20 having a cathode 11 with a pointed end 9, in accordance with an embodiment of the present invention.
Figure 3:
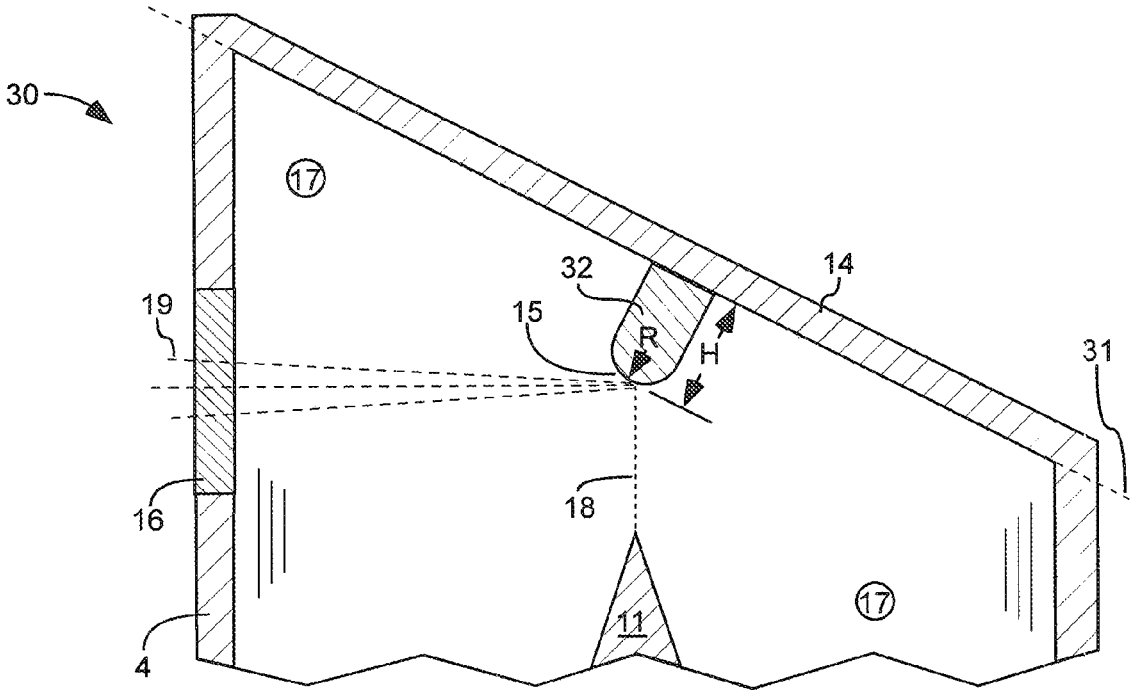
FIG. 3 is a schematic cross-sectional side view of a side-window x-ray source 30 comprising a cathode 12 with a pointed end 9 and an anode 14 with a protrusion 32, in accordance with an embodiment of the present invention.
Figure 4:
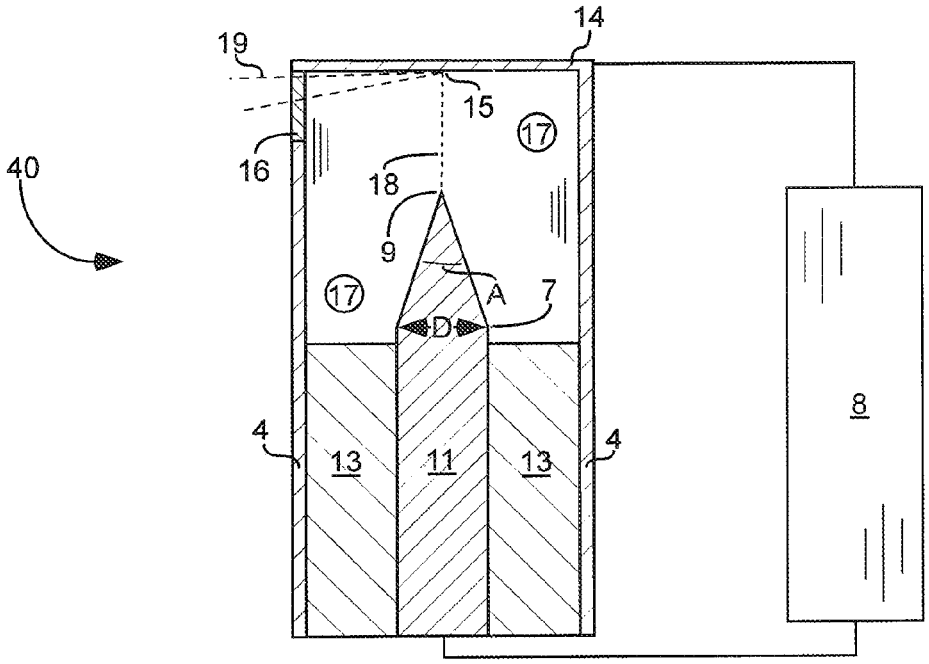
FIG. 4 is a schematic cross-sectional side view of a side-window x-ray source 40 having a cathode 11 with a pointed end 9, in accordance with an embodiment of the present invention.
Figure 6:
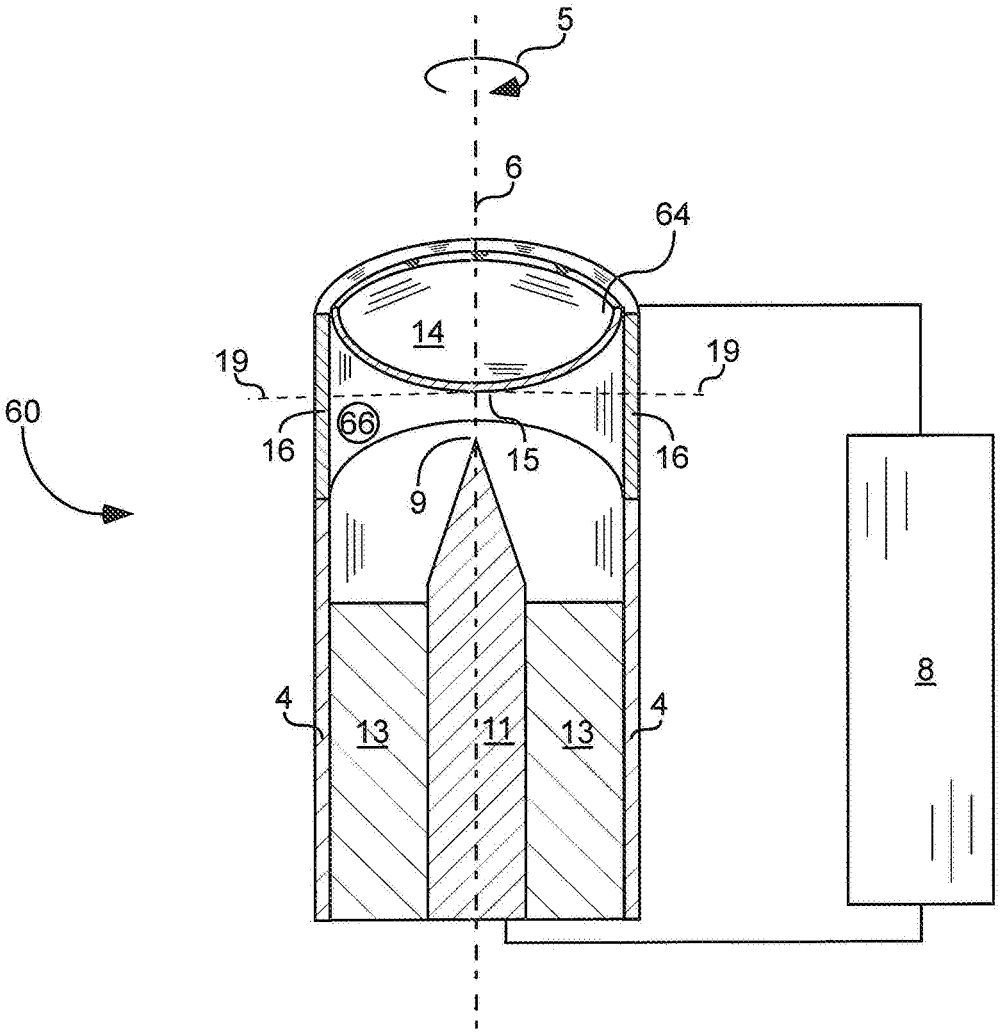
FIG. 6 is a schematic, perspective, cross-sectional side view of a side-window x-ray source 60 including a window 16 with an annular-shape 66 and an anode 14 including a half-ball-shape 64, in accordance with an embodiment of the present invention.

As shown in FIGS. 1-2 and 6, the cathode 11 can be aligned along a longitudinal axis 6 of the enclosure 4. A cross sectional view at any point in a 360° arc 5 of rotation of the x-ray source 10, 20, or 60 around the longitudinal axis 6 can show the pointed end 9 of the cathode. Thus, the pointed end 9 of the cathode 11 can have a circular cross section substantially transverse to a longitudinal axis 6 of the enclosure 4.

Figure 5:
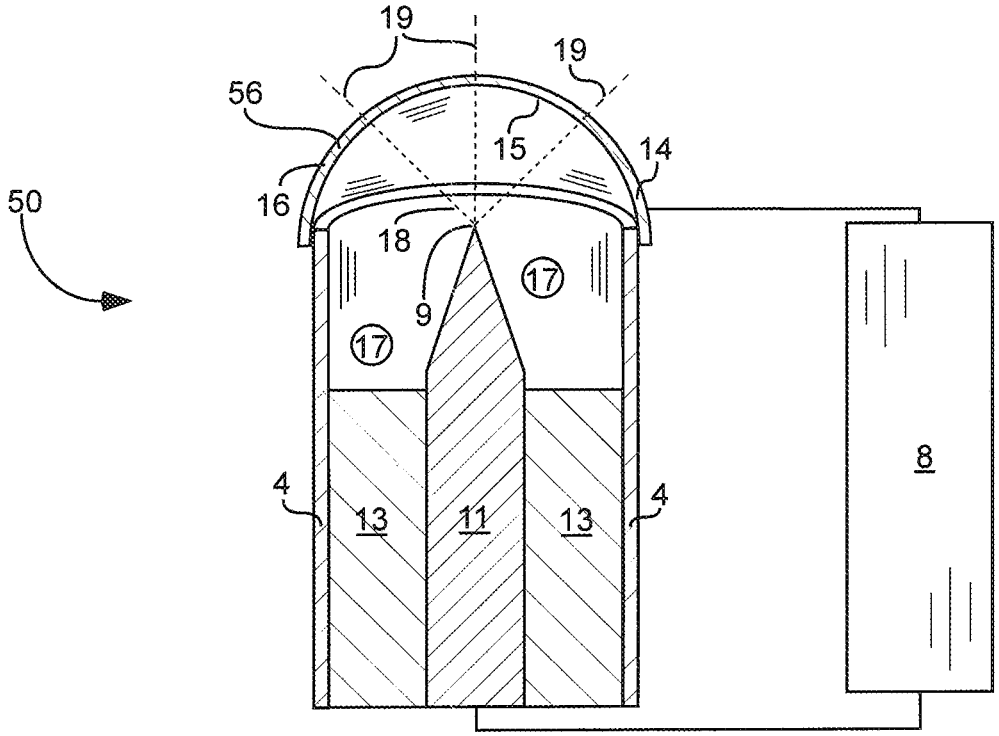
FIG. 5 is a schematic cross-sectional side view of an end-window, transmission-target x-ray source 50 including a window 16 having a hollow, bowl-shape with a concave portion facing a cathode 11 with a pointed end 9, in accordance with an embodiment of the present invention.

X-ray sources 10 and 50 in FIGS. 1 and 5 are end-window, transmission-target types of x-ray sources. The pointed end 9 of the cathode 11 and the window 16 can both be aligned with the longitudinal axis 6 of the enclosure 4. A target material 15, configured to emit x-rays 19 in response to impinging electrons from the cathode 11, can be disposed on the window 16.

X-ray sources 20, 30, 40, and 60 in FIGS. 2-4 and 6 are side window types of x-ray sources. The window 16 is disposed in a lateral side of the enclosure 4. The target material 15 can be disposed on the anode 14 and can be located to receive impinging electrons 18 from the cathode 11 and to emit x-rays 19 towards the window 16. X-rays 19 can travel from the anode 14, through the cavity 17, to the window 16. A choice among these different side window and transmission-target designs can be based on desired shape of x-ray flux output, cost, and overall use of the x-ray source.

As shown on x-ray source 20 in FIG. 2, the anode 14 can include an inclined region having an acute angle $A_2$ with respect to the longitudinal axis 6. The target material 15 can be disposed on the inclined region of the anode 14. As shown on x-ray source 40 in FIG. 4, the anode 14 need not necessarily have an acute angle with respect to the longitudinal axis 6. The anode 14 can be substantially perpendicular respect to the longitudinal axis 6. A choice of whether to have the anode 14 perpendicular or at an acute angle $A_2$ with respect to the longitudinal axis 6 can depend on manufacturability, cost, and desired shape of x-ray 19 emission.

It can be beneficial for imaging applications for the x-rays 19 to emit from a point source. Emission of x-rays from a point source, rather than from a broad surface of the anode 14, may be accomplished by a protrusion 32 extending from a face 31 of the anode 14 (see FIG. 3). The protrusion 32 can be disposed at the inclined region. The protrusion 32 can face the pointed end 9 of the cathode 11. It can be beneficial for the protrusion 32 to be small so that x-rays emit from a point source. Thus, a radius of curvature R at a distal end of the protrusion 32 can be less than 0.5 millimeters. A relationship between the radius of curvature R and a distance H from the face 31 of the anode 14 to the distal end of the protrusion 32 can affect x-ray emission. The distance H from the face 31 of the anode 14 to the distal end of the protrusion 32 can be greater than two times the radius of curvature R. In one embodiment, the face 31 of the anode 14 can be substantially flat except for the protrusion 32, providing a single point source. Experimentation has shown good focusing of x-rays with a diameter D of the cathode 11, at a location where the cathode 11 begins to taper towards the pointed end 9, that is less than 0.75 times the radius of curvature R at the distal end of the protrusion 32. The protrusion 32 can be made by pressing a dimple in the metal, by welding a small bump or stick onto the anode 14, or other suitable method.

As shown on x-ray source 50 in FIG. 5, the window 16 can have a hollow, bowl-shape 56 with a concave portion facing the cavity 17. The window 16 can cap one end of the enclosure 4. The concave portion of the bowl-shape 56 can include a target material 15 configured to emit x-rays 19 in response to impinging electrons 18 from the cathode 11. The entire concave portion can be coated with the target material 15. The bowl-shape 56 itself can be made of the target material or the target material can be coated on an inside, concave part of the bowl-shape 56. The target material can be or can comprise tungsten. The bowl-shape 56 can be made of or can comprise tungsten, carbon fiber composite, and/or graphite. An advantage of this design is a hemispherical-shaped (wide angle) emission of x-rays 19 from the x-ray source 50.

Figure 7A:
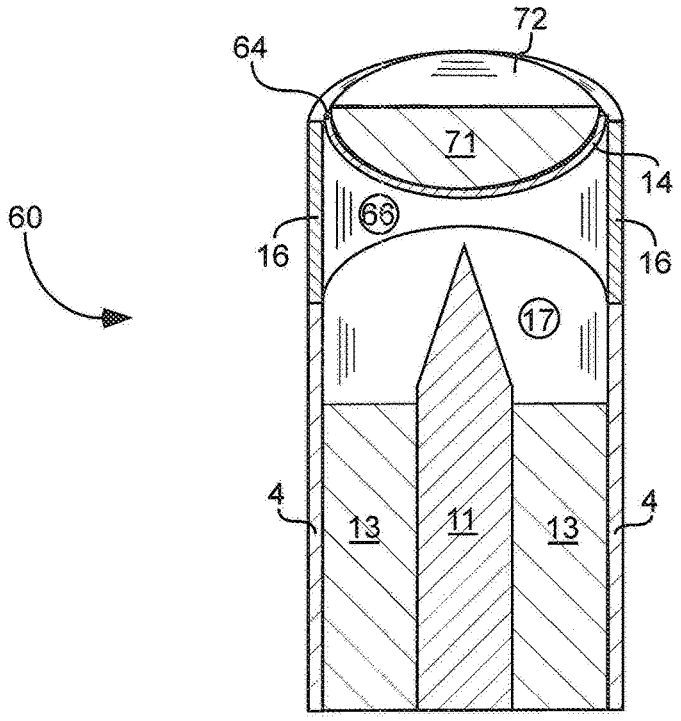
FIGS. 7*a* and 7*b* are schematic, cross-sectional side views of at least a portion of side-window x-ray source 60, similar to that shown in FIG. 6, but further comprising a support 71 inserted into a concave hollow of the half-ball-shape 64, in accordance with an embodiment of the present invention.
Figure 7B:
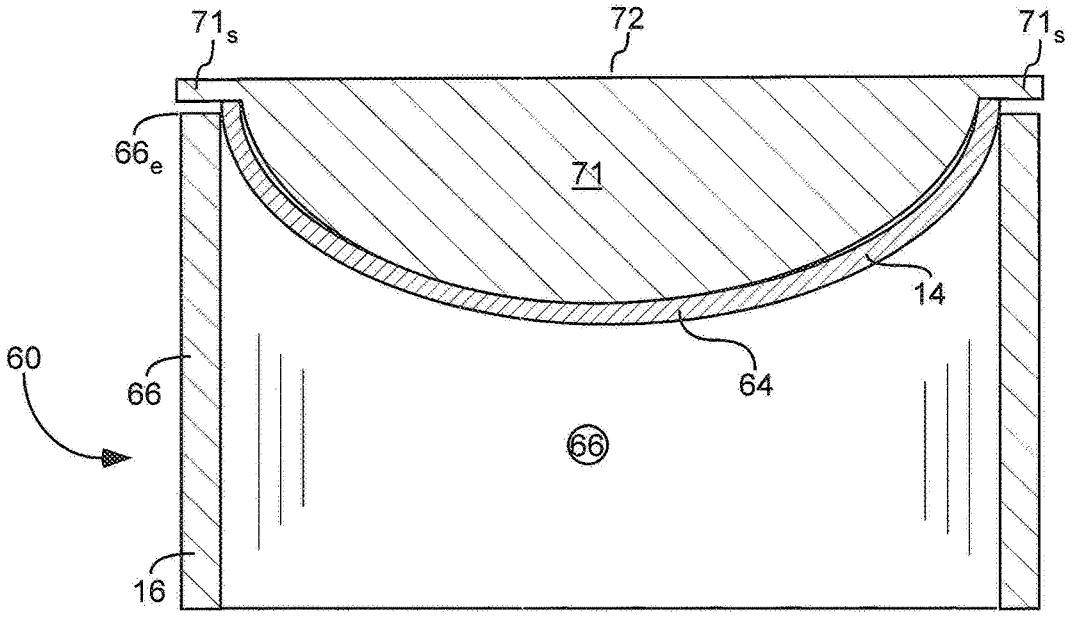

As shown on x-ray source 60 in FIGS. 6, 7*a* and 7*b*, the window 16 can include an annular-shape 66, forming a ring as one section of the enclosure 4. The annular-shape 66 can form the entire tube-portion of the enclosure 4 and thus the enclosure can be formed of the annular-shape 66, the anode 14, and the cathode 11. The anode 14 can include a half-ball-shape 64 with a convex portion extending into the cavity 17 and into a hollow of the annular-shape 66 of the window 16. The convex portion can include a target material 15 configured to emit x-rays 19 in response to impinging electrons 18 from the cathode 11. The target material 15 can be or can comprise tungsten.

The half-ball-shape of the anode 14 can be made of or can comprise various materials, such as for example refractory metals, tungsten, metal carbide, metal boride, metal carbon nitride, and/or noble metals. The half-ball-shape 64 of the anode 14 can have a hollow, concave portion opposite of the convex portion like half of a tennis ball (see FIGS. 6, 7*a* and 7*b*) or can be solid like half of a baseball (see FIG. 14).

The annular-shape 66 of the window 16 can be made of or can comprise various materials, such as for example carbon fiber composite, graphite, plastic, glass, beryllium, and/or boron carbide. Advantages of using carbon-based materials include low atomic number and high structural strength. An advantage of a window 16 that comprises an annular-shape 66 is a 360° ring-like (wide angle) emission of x-rays 19 around the longitudinal axis 6. For some applications, a hemispherical-shaped emission of x-rays 19, as shown in FIG. 5 may be preferred, but in other applications, a 360° ring-like emission of x-rays may be preferred.

As shown in FIGS. 7*a* and 7*b*, the half-ball-shape 64 of the anode 14 can be hollow (e.g. bowl-shaped). The anode 14 can be supported by the annular-shape 66 of the window 16. The half-ball-shape 64 can include a convex portion extending into the cavity 17. The convex portion can extend into a hollow of the annular-shape 66 of the window 16. The half-ball-shape 64 can include a concave hollow, opposite of the convex portion. An electrically-insulative support 71 can be inserted into the concave hollow of the half-ball-shape 64 and can have a shape to substantially match the concave hollow. The support 71 can be solid and can include a half-ball-shape. The support 71 can include or can be a polymer, such as polyether ether ketone (PEEK) for example. The x-ray source 60, along with the support 71, can be used to lift a device.

A portion of the support 71 can extend out of the concave hollow of the half-ball-shape 64. The support can have a substantially flat portion 72 facing away from the anode 14. The flat portion 72 can be configured to bear against the device (e.g. flat panel display 83).

As shown in FIG. 7*b*, the support 71 can include an outer-portion, lip, extension, or shield $\mathbf{71}_s$ that extends at least partially over the annular-shape 66 of the window 16. The shield $\mathbf{71}_s$ can extend to or over an outer edge $\mathbf{66}_e$ of the annular-shape 66. The shield $\mathbf{71}_s$ can electrically insulate the window 16 from the device (e.g. flat panel display 83) and thus help avoid electrical arcing between the window 16 and the device.

Figure 8:
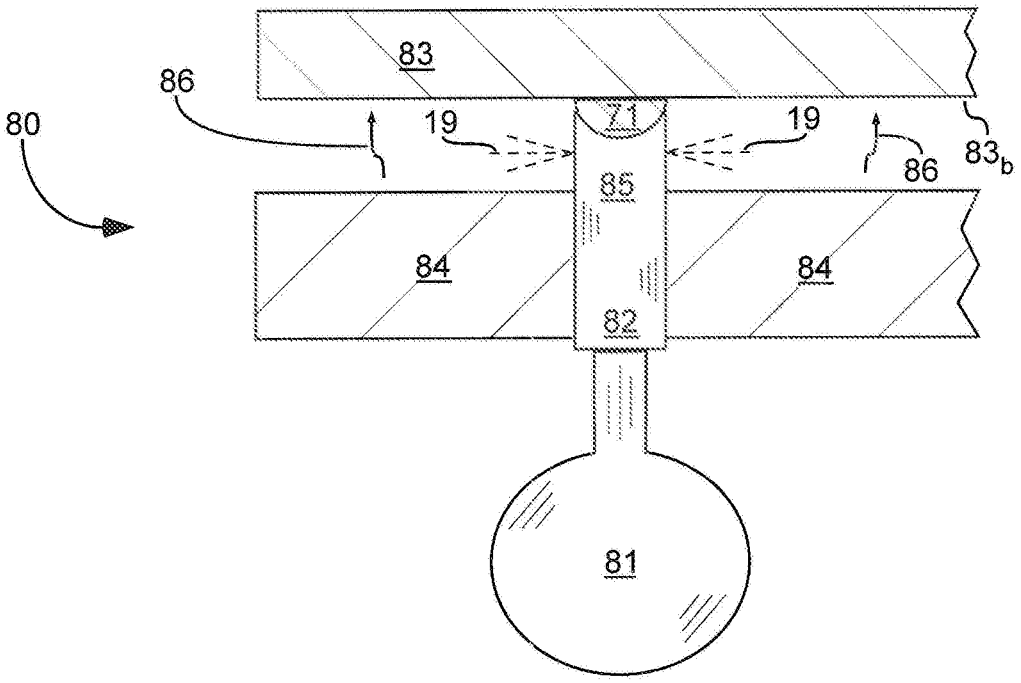
FIG. 8 is a schematic cross-sectional side view of a manufacturing system 80 including an x-ray source 85 being used as at least part of a lift pin 82 for lifting a flat panel display 83 off of a table 84, in accordance with an embodiment of the present invention.
Figure 9:
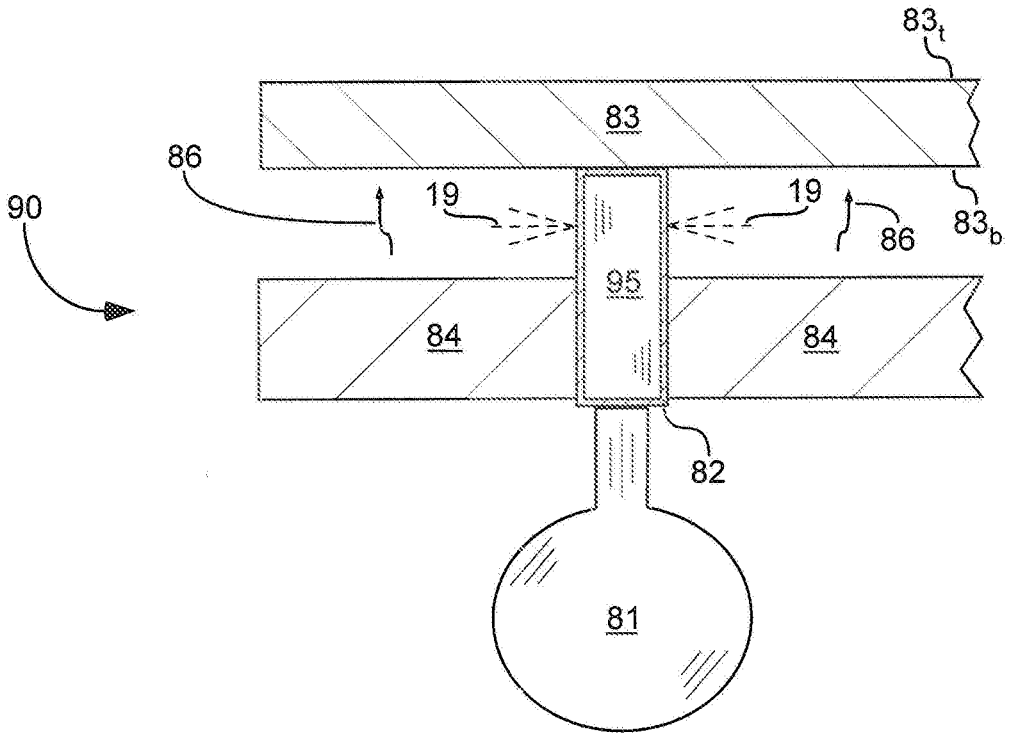
FIG. 9 is a schematic cross-sectional side view of a manufacturing system 90 including an x-ray source 95 disposed within a lift pin 82, the lift pin being used for lifting a flat panel display 83 off of a table 84, in accordance with an embodiment of the present invention.

As shown in FIGS. 8-9, x-ray sources 85 and 95, such as those described above, can be used as part of manufacturing systems 80 and 90 for manufacture of a flat panel display 83. During manufacture, there can be potentially-harmful electrostatic charges on a bottom-side $83_b$ of the flat panel display 83. Rapid electrostatic discharge can damage the bottom-side $83_b$ of the flat panel display 83. Harmful electrostatic discharge typically occurs as lift pins 82 lift the flat panel display 83 off of the table 84. The lift pins 82 typically are movably disposed in holes in the table 84. An actuator 81 can apply a force to each lift pin 82 and the lift pin 82 can apply a force to the flat panel display 83. Thus, multiple lift pins 82 working together can lift the flat panel display 83 off of the support table 84. A voltage differential between the table 84 and the flat panel display 83 can occur due to a different material of the table 84 from that of the flat panel display 83. One of these two materials can have a stronger affinity for electrons than the other.

X-rays 19 can smoothly or gradually dissipate the electrostatic charges, without rapid, harmful electrostatic discharge, by forming ions in the fluid 86 (e.g. air) between the flat panel display 83 and the table 84. The ions can smoothly and gradually reduce the electrostatic charges on the flat panel display 83. It can be difficult, however, to emit x-rays 19 throughout the entire region between the flat panel display 83 and the table 84. Embodiments of the present invention include associating, the x-ray sources 85 or 95, such as those described above, with the lift pin 82. The x-ray sources 85 or 95 can be movable with the lift pin 82. The x-ray sources 85 or 95 can emit x-rays 19 between the flat panel display 83 and the table 84 while the flat panel display 83 is lifted off of the table 84 and/or soon thereafter. Because the lift pins 82 can be distributed at various locations, associating the x-ray sources 85 or 95 with the lift pins 82 can provide effective emission of x-rays 19 into a large portion or all of the region between the flat panel display 83 and the table 84.

As shown on manufacturing system 80 in FIG. 8, the x-ray source 85 can be the entire lift pin 82 or can be a vertical section of the lift pin 82. Thus, the x-ray source 85, along with no other support structure, can form a vertical segment of the lift pin 82. Any of the x-ray sources described herein can be used, but x-ray sources 60 and 140 may be especially applicable. The support 71 can be configured to face the flat panel display 83.

As shown on manufacturing system 90 in FIG. 9, the x-ray source 95 can be disposed within an electrically insulative region of the lift-pin 82. Any of the x-ray sources described herein can be used, but x-ray sources 60 or 140 may be especially applicable. The lift-pin 82 can be configured by thickness of material or by holes in the lift-pin 82, and the x-ray source 95 can be disposed in a location, to allow x-rays 19 to pass from sides of the x-ray source 95 out of the lift-pin 82 and between the flat panel display 83 and the table 84.

Figure 11:
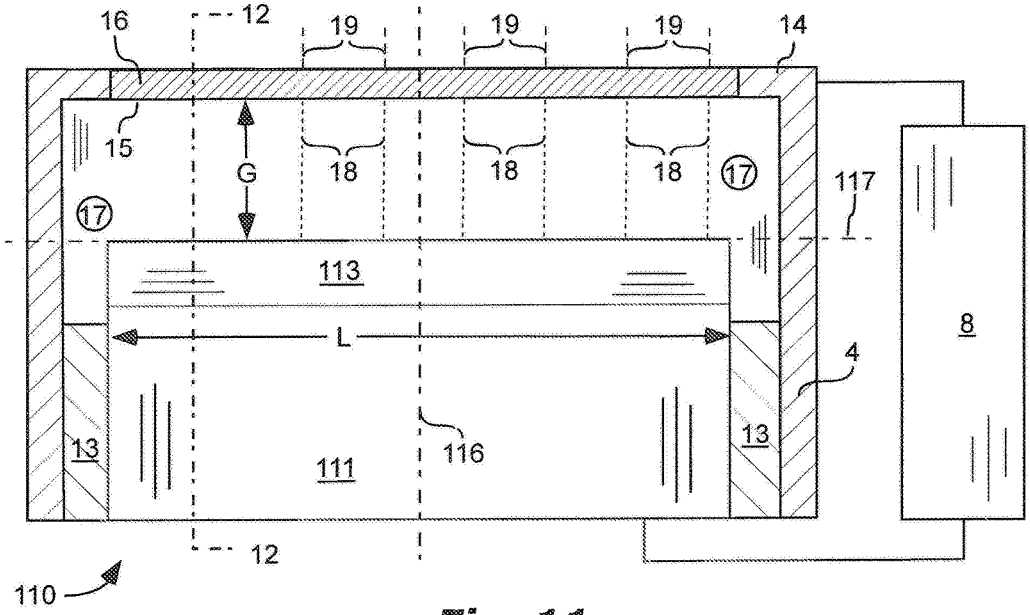
FIG. 11 is a schematic, longitudinal, cross-sectional side view of an x-ray source 110 wherein the cathode 112 includes an elongated blade 113 oriented substantially transverse 117 with respect to an axis 116 extending from the cathode 112 to a target material 15, in accordance with an embodiment of the present invention.
Figure 12:
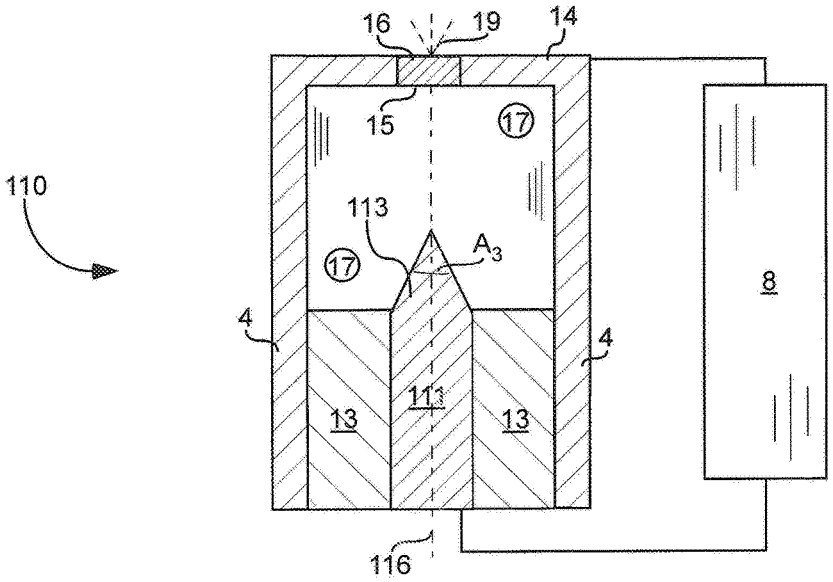
FIG. 12 is a schematic, lateral cross-sectional side view of the x-ray source 110 of FIG. 11 taken along line 12-12 in FIG. 11, in accordance with an embodiment of the present invention.

As shown in FIGS. 11 and 12, x-ray source 110 can comprise an enclosure 4 including an internal cavity 17 with an anode 14 and a cathode 111 attached to the enclosure 4. The cathode 111 and the anode 14 can be electrically-conductive. The cathode 111 and the anode 14 can be spaced apart from each other and can be electrically insulated from each other. An axis 116 of the enclosure 4 can extend from the cathode 111 to a target material 15 disposed on the anode 14 or window 16. The axis 116 can be substantially perpendicular to a face of the window 16. The target material 15 can be configured to emit x-rays 19 in response to impinging electrons 18 from the cathode 111. A distal free-end of the cathode 111 can have an elongated blade 113 oriented substantially transverse with respect to the axis 116 of the enclosure 4. The elongated blade 113 can be disposed within the cavity 17 and can be directed or pointed towards the anode 14 with a gap G between the blade 113 and the anode 14. An electrically-conductive window 16 can be associated with and can be electrically connected to the anode 14. The window 16 can be substantially transmissive to x-rays 19. The window 16 can form at least part of a wall of the enclosure 4. The window 16 can separate at least a portion of the cavity 17 from an exterior of the enclosure 4. An end-window transmission-target x-ray source 110 is shown in FIGS. 11 and 12, but the elongated blade 113 cathode 111 can also be used in a side window x-ray source.

X-ray source 110, with an elongated blade 113 of the cathode 111, can be beneficial for emission of an elongated line or curtain of x-rays 19 in order to cover a large area, such as for example a top side $83_t$ of a flat panel display 83 during manufacture of the flat panel display 83. The blade 113 can have a length of at least 10 centimeters in one aspect, at least 20 centimeters in another aspect, or at least 80 centimeters in another aspect.

Figure 14:
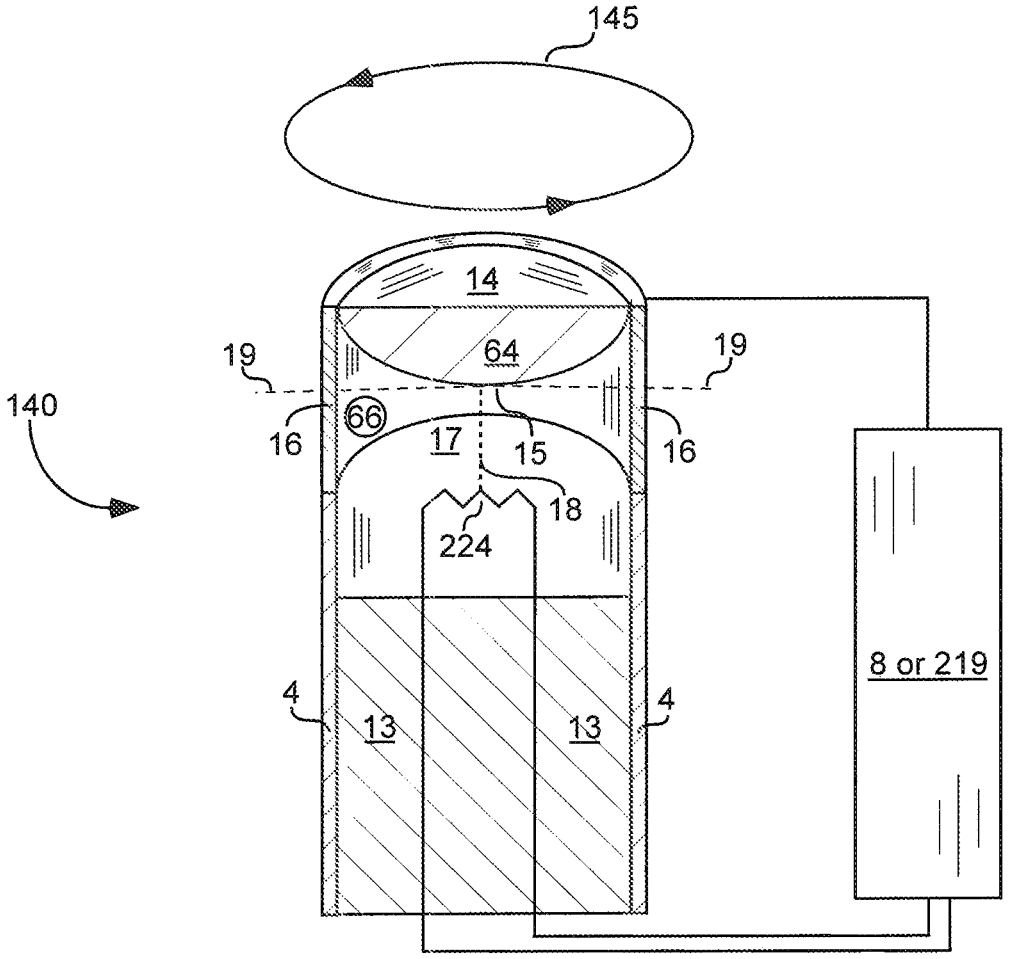
FIG. 14 is a schematic, perspective, cross-sectional side view of a side-window x-ray source 140 including a window having an annular-shape 66 and an anode 14 having a half-ball-shape 64, in accordance with an embodiment of the present invention.

Shown in FIG. 14 is x-ray source 140, comprising an enclosure 4 having an internal cavity 17. The internal cavity 17 can be evacuated. An anode 14 and an electron emitter 224 (e.g. filament) can be attached to the enclosure 4. The anode 14 and the electron emitter 224 can be spaced apart from each other and can be electrically insulated from each other. The anode 14 and the electron emitter 224 can be electrically-conductive.

A window 16 can form a hollow-ring as one section of the enclosure 4. The window 16 can be electrically-conductive, can include an annular-shape 66, and can be substantially transmissive to x-rays 19. The window 16 can separate at least, a portion of the cavity 17 from an exterior of the enclosure 4. In one embodiment, the window 16 can comprise tungsten, carbon fiber composite, and/or graphite.

The anode 14 can include a half-ball-shape 64 having a convex portion extending into the cavity 17 and into a hollow of the annular-shape 66. The electron emitter 224 can emit electrons 18 towards the anode 14. The convex portion of the anode 14 can include a target material 15 configured to emit x-rays 19 in response to impinging electrons 18 from the electron emitter 224. In one embodiment, the x-ray source 140 can emit x-rays 19 in a 360° circle 145 outward from the x-ray source 140.

Figure 15:
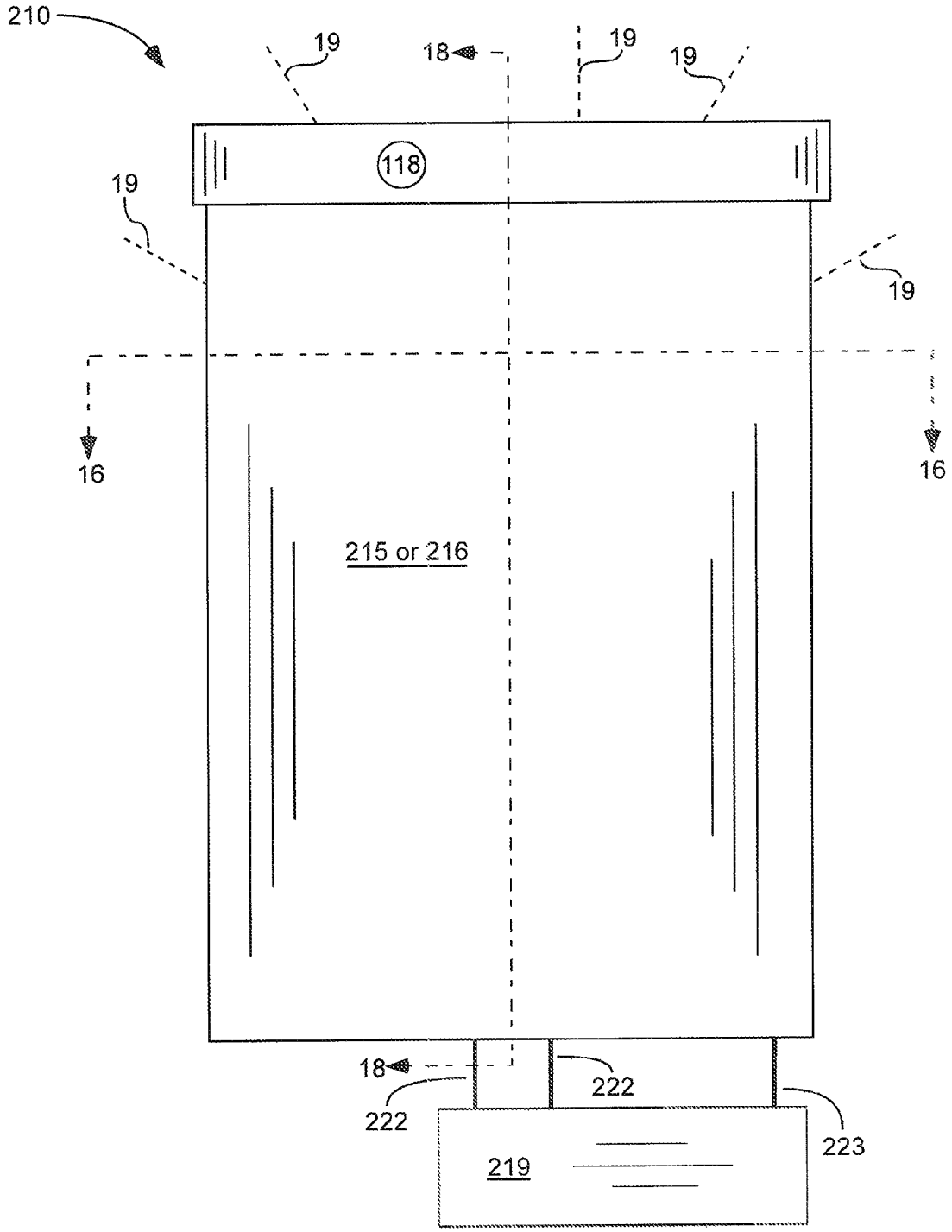
FIG. 15 is a schematic perspective view of an x-ray source 210 including a shell 215 circumscribing at least a portion of an x-ray tube 225 (FIG. 18), in accordance with an embodiment of the present invention.
Figure 16:
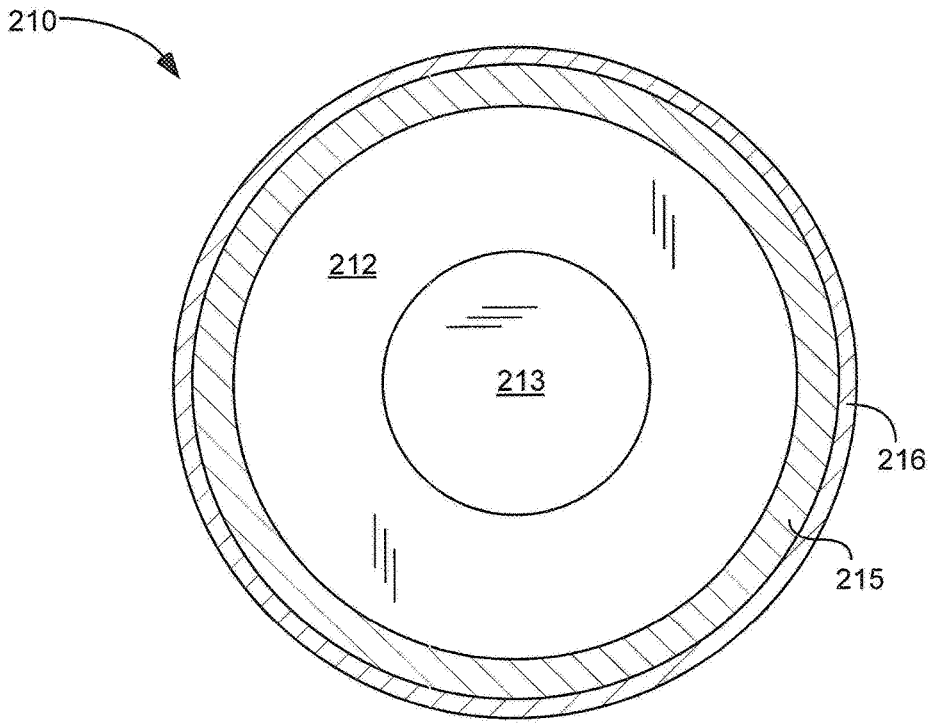
FIG. 16 is a schematic, cross-sectional, latitudinal, end view of the x-ray source 210 of FIG. 15 (without the power supply) taken along line 16-16 in FIG. 15, in accordance with an embodiment of the present invention.
Figure 17:
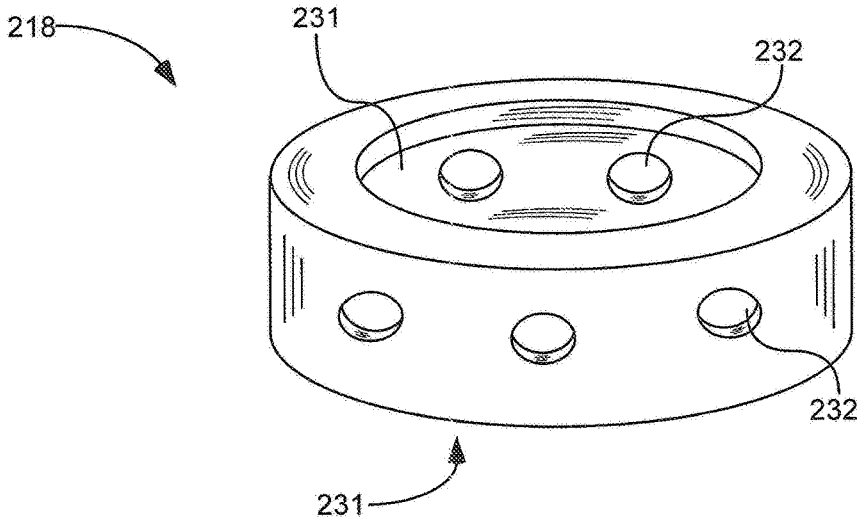
FIG. 17 is a schematic perspective view of a cap 218 for an x-ray source, in accordance with an embodiment of the present invention.
Figure 18:
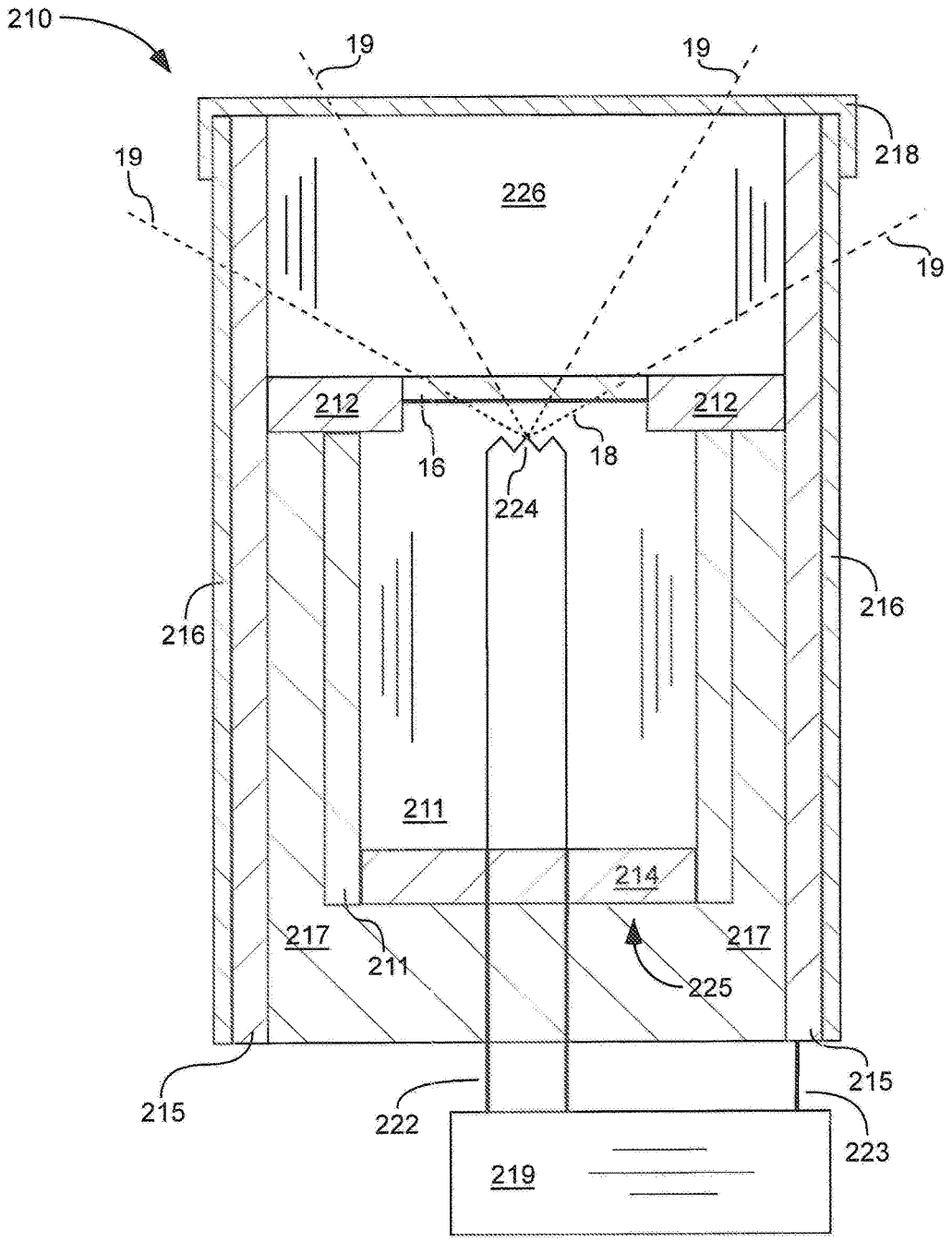
FIG. 18 is a schematic cross-sectional longitudinal side view of the x-ray source of FIG. 15 taken along line 18-18 in FIG. 15, in accordance with an embodiment of the present invention.
Figure 19:
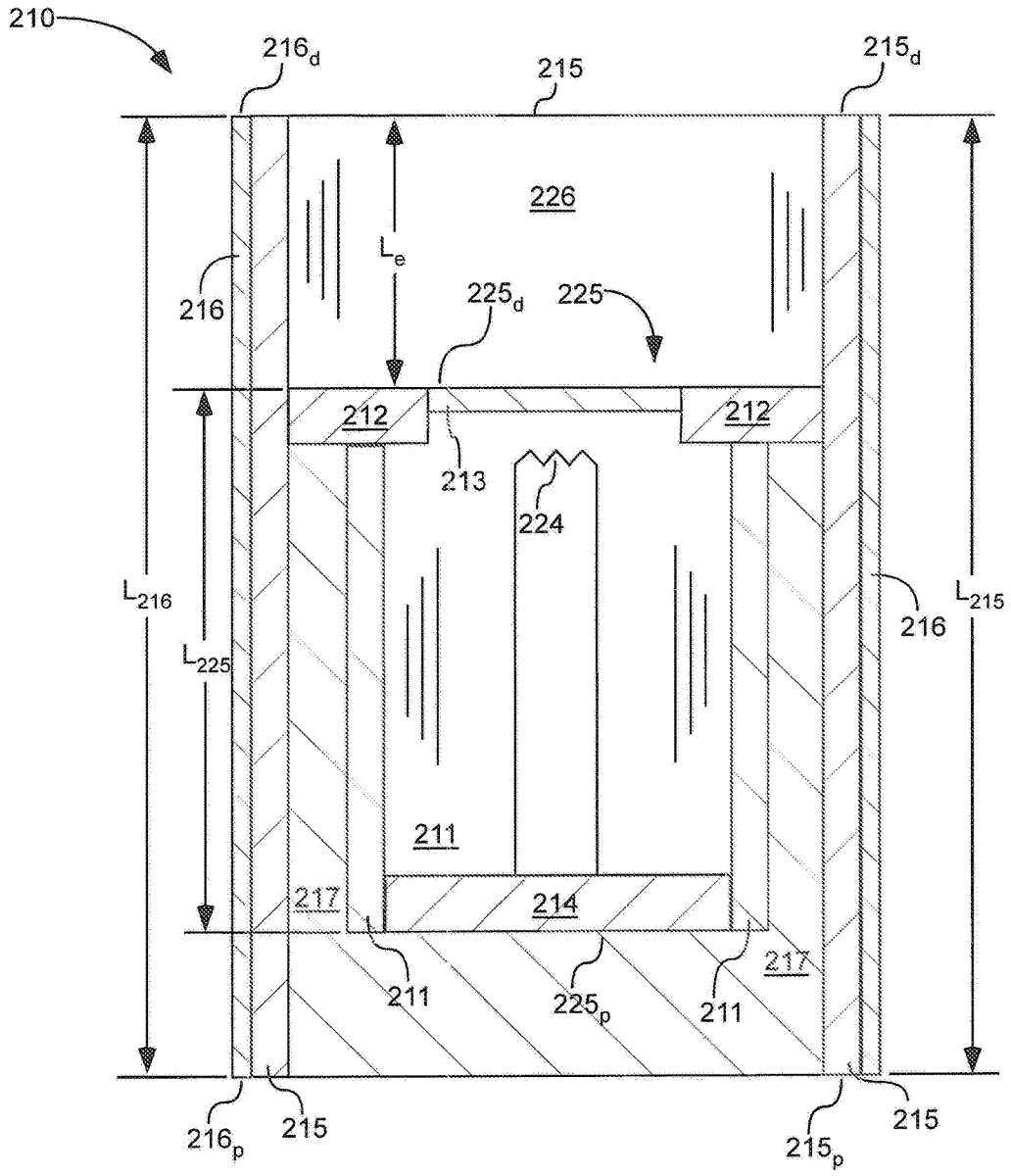
FIG. 19 is a schematic cross-sectional longitudinal side view of the x-ray source 210 of FIG. 18, but without the power supply 219 or the cap 218, in accordance with an embodiment of the present invention.
Figure 20:
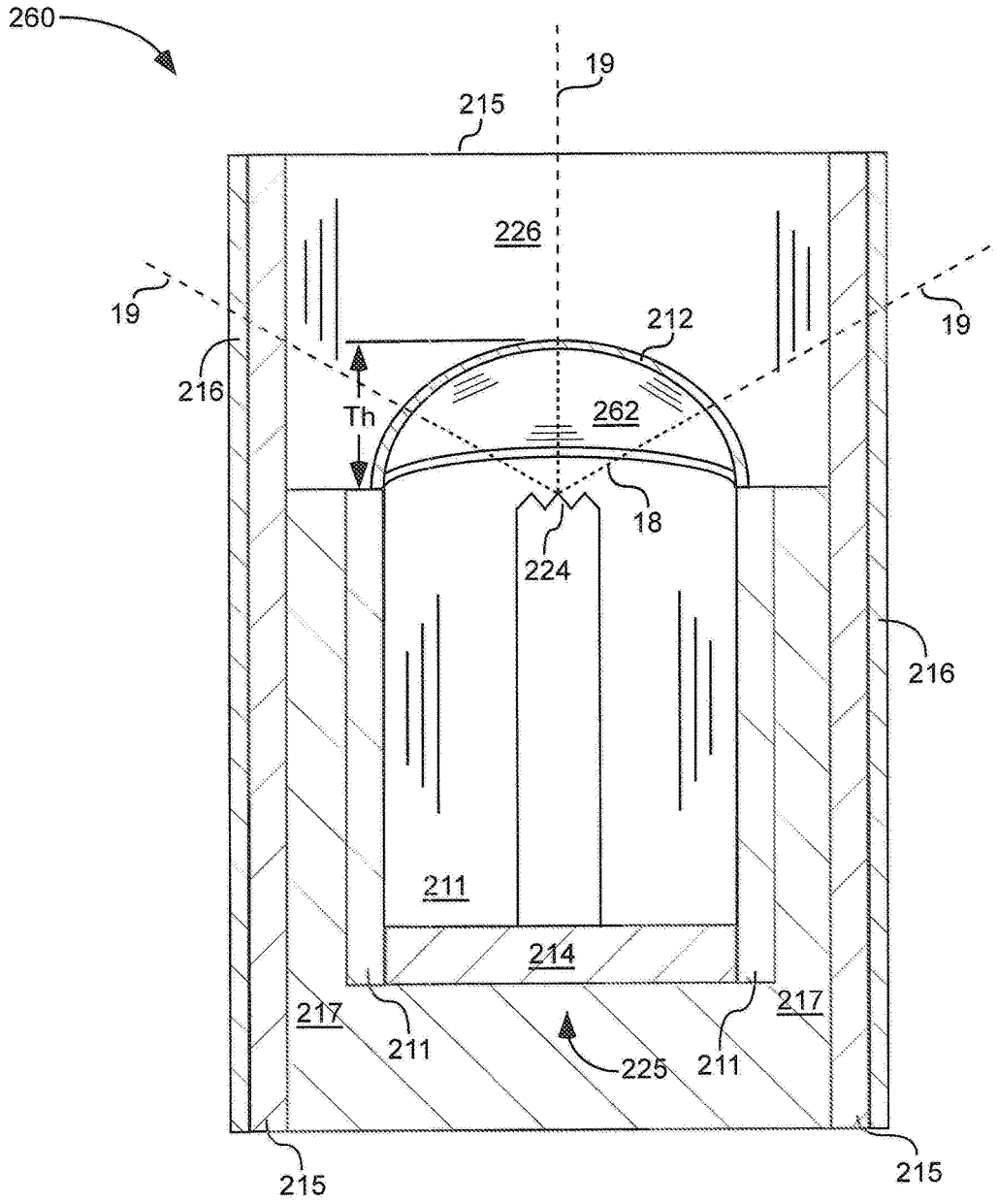
FIG. 20 is a schematic cross-sectional longitudinal side view of an x-ray source 260 that is similar to x-ray source 210, but with a dome-shaped anode 262, in accordance with an embodiment of the present invention.
Figure 21:
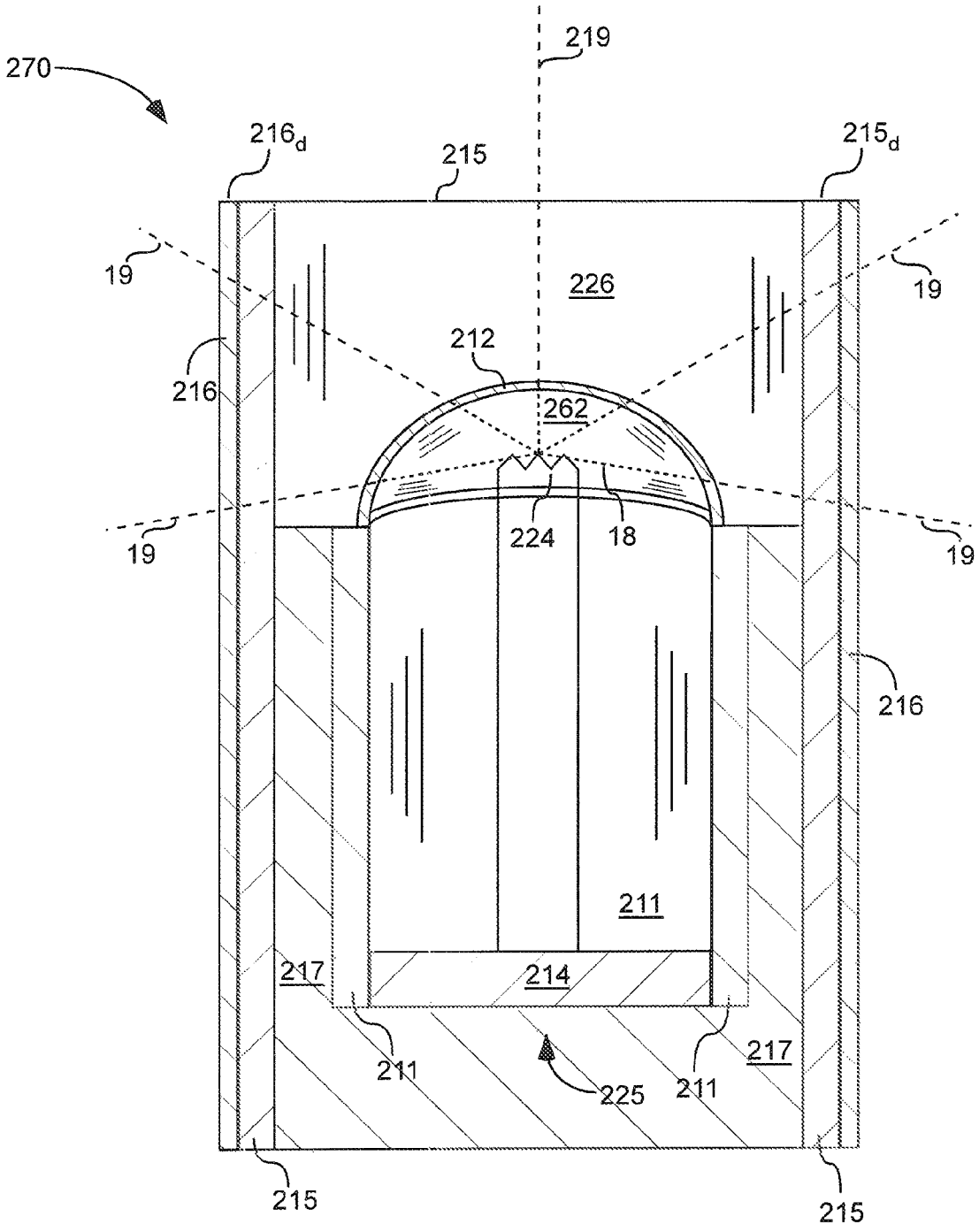
FIG. 21 is a schematic cross-sectional longitudinal side view of an x-ray source 270 that is similar to x-ray source 260, but with the electron emitter 224 disposed inside of the dome-shaped anode 262, in accordance with an embodiment of the present invention.

Illustrated in FIGS. 15 and 18 is an x-ray source 210 including an x-ray tube 225 and a power supply 219. FIGS. 16 & 19 show other views of x-ray source 210. FIGS. 20 & 21 show x-ray sources 260 and 270, respectively, which are similar to x-ray source 210, but with a dome-shaped anode 262. The power supply 219 is not shown in FIGS. 20-21, but can be used with the x-ray sources 260 and 270 shown therein. FIG. 17 shows an optional cap 218 for x-ray sources 210, 260, or 270.

The x-ray tube 225 can include a cathode 214 and an anode 212. The cathode 214 can be electrically insulated from the anode 212 and can be separated from the anode 212 by an electrically insulative enclosure 211. For example, the electrically insulative enclosure 211 can have an electrical resistivity of at least $1\times10^{12}$ in one aspect, at least $7\times10^{12}$ in another aspect, or at least $1\times10^{13}$ in another aspect.

The cathode 214 can be configured to emit electrons 18 towards the anode 212 (e.g. due to cathode 214 heat and a large bias voltage differential between the cathode 214 and the anode 212). The anode 212 can be configured to emit x-rays 19 (e.g. due to target material of or on the anode 212) outward from the x-ray tube 225 in response to impinging electrons 18 from the cathode 214. Transmission target x-ray sources 210, 260, and 270 are shown in the figures, but the invention described herein is also applicable to a side-window type of x-ray source.

A shell 215 can circumscribe at least a portion of the x-ray tube 225. The shell 215 can be electrically coupled to the anode 212 and can be electrically insulated from the cathode 214. The shell 215 can conveniently be used as an electrical current path for removing electrical charge from the anode 212. If the shell 215 is used as a primary or sole electrical path for electrical current flow away from the anode 212, and/or there is limited means of conducting heat away from the x-ray source 210, 260, or 270, then it can be important for the shell 215 to have a relatively high electrical conductivity because electrical resistance of the shell 215 can result in increased shell 215 temperature, which can lead to heat damage of the x-ray source 210, 260, or 270, power supply 219, and/or surrounding materials. For example, the shell 215 can have an electrical resistivity less than 0.02 ohm*m in one aspect, less than 0.05 ohm*m in another aspect, less than 0.15 ohm*m in another aspect, or less than 0.25 ohm*m in another aspect.

The power supply 219 can provide electrical power (e.g. through electrical connectors 222) to an electron emitter 224 (e.g. to cause electrical current, to flow through a filament to heat the filament). The power supply 219 can provide a voltage differential (e.g. a few to tens of kilovolts) between the electron emitter 224 and the anode 212. The power supply can maintain the cathode 214 at a low voltage (e.g. −10 kV) and the anode 212 at a higher voltage (e.g. ground voltage). Electrical connections for transferring electrical power from the anode 212 can be through the shell 215 and from the shell 215 through electrical connection 223 to the power supply 219 or to a separate ground. The shell 215 can conveniently be used as an electrical current path, thus avoiding the expense and space required of an added component.

The shell 215 can substantially circumscribe the anode 212. The shell 215 can circumscribe (or substantially circumscribe if the shell 215 includes holes) a length $L_{225}$ of the x-ray tube 225. The shell 215 can have a length $L_{215}$ longer than the length $L_{225}$ of the x-ray tube 225. The shell 215 can have a distal end $\mathbf{215}_d$ closer to the anode 212 and a proximal end $\mathbf{215}_p$ closer to the cathode 214. The x-ray tube 225 can have a distal end $\mathbf{225}_d$ closer to the anode 212 and a proximal end $\mathbf{225}_p$ closer to the cathode 214. The distal end $\mathbf{215}_d$ of the shell 215 can extend beyond the distal end $\mathbf{225}_d$ of the x-ray tube 225 away from the x-ray tube 225.

There can be a hollow region 226 disposed within the shell 215 between the distal end $\mathbf{225}_d$ of the x-ray tube 225 and the distal end $\mathbf{215}_d$ of the shell 215. This hollow region 226 can provide a protective region for the x-ray tube 225 and/or a region to allow x-rays 19 to expand outward. A region to allow x-rays 19 to expand outward can be important if the distal end $\mathbf{215}_d$ of the shell is used to press against a device (e.g. flat panel display) and space is needed for x-rays 19 to emit out between the device and the x-ray tube 225. A proper length $L_e$ of this extension of the shell 215/protective region 226 can be important for proper angle of distribution of x-rays 19, and can vary, depending on the application of use. For example, the distal end $\mathbf{215}_d$ of the shell 215 can extend beyond the distal end $\mathbf{225}_d$ of the x-ray tube 225, away from the x-ray tube 225, for a distance of between 3 and 10 millimeters in one aspect or between 2 and 20 millimeters in another aspect.

A sheath 216 can circumscribe at least a portion of the shell 215 and the anode 212. The sheath 216 can be electrically resistive in order to avoid creating undesirable electrical current paths away from the shell 215. For example, if the x-ray source 210, 260, or 270 is used as a lift pin for lifting a flat panel display off of a table during manufacture of the flat panel display, it can be desirable to avoid the shell 215 discharging electrical current through the table. The sheath 216 can thus be used to avoid such undesirable electrical current paths. As an example of electrical resistivity of the sheath 216, the sheath 216 can have an electrical resistivity of greater than 100 ohm*m in one aspect or greater than 500 ohm*m in another aspect.

A distal end $\mathbf{216}_d$ of the sheath 216 can extend beyond the distal end $\mathbf{225}_d$ of the x-ray tube 225 away from the x-ray tube 225 (for example, for a distance of between 3 and 10 millimeters in one aspect or between 2 and 20 millimeters in another aspect). The sheath 216 can substantially surround a length $L_{215}$ of the shell 215. The sheath 216 can have a length $L_{216}$ that is the same as the length $L_{215}$ of the shell 215. The sheath 216 can have a distal end $\mathbf{216}_d$ that terminates at the distal end $\mathbf{215}_d$ of the shell 215 and/or a proximal end $\mathbf{216}_p$ that terminates at the proximal end $\mathbf{215}_p$ of the shell 215.

Referring to FIGS. 15, 17 and 18, a cap 218 can be disposed at the distal end $\mathbf{215}_d$ of the shell 215. The cap 218 can be electrically resistive in order to avoid creating undesirable electrical current paths away from the shell 215 at the distal end $\mathbf{215}_d$ of the shell 215. For example, the cap 218 can have an electrical resistivity of at least $5\times10^{13}$ ohm*m in one aspect, at least $1\times10^{14}$ ohm*m in another aspect, at least $2.5\times10^{14}$ ohm*m in another aspect, or at least $4.0\times10^{14}$ ohm*m in another aspect.

In one aspect, the cap 218 can be used to provide an electrically insulative barrier between the shell 215 and a flat panel display when lifting the flat panel display off of a table during manufacture. The cap 218 can include or can be a polymer, such as polyether ether ketone (PEEK) for example. PEEK can be useful due to relatively high electrical resistivity. For this application, it may be preferred for the cap 218 to have two open ends 231, forming a hollow within the cap, to allow convective heat transfer away from the x-ray tube 225. It can also be preferable for the cap 218 to have openings 232 around a perimeter to allow improved x-ray 19 transmissivity away from the x-ray source 210, 260, or 270. The cap 218 can fit over the distal end $\mathbf{215}_d$ of the shell 215 with a flange inserted inside or outside of the shell 215 or can be flat like a washer and can be attached to the shell 215 with an adhesive.

In another aspect, the cap 218 and the shell 215 surrounding the hollow region 226 can be made of materials and thicknesses capable of protecting the anode 212 from corrosive chemicals. The cap 218 can cover the distal end $\mathbf{215}_d$ of the shell 215, thus enclosing the hollow region 226 between the anode 212 and the cap 218. The cap can be sealed to the shell 215 to prevent chemical damage to the x-ray tube 225. Thus, a trade-off may be needed between (1) protecting the x-ray tube 225 from chemical damage and (2) improved convective cooling of the anode plus improved x-ray 19 transmissivity out of the cap 218. The cap can be made of various materials, including polymers and composites. If electrical resistivity of the cap 218 is not important, then the cap can be made of carbon fiber composite and/or can be integrally connected to or formed with the shell 215.

Proper selection of materials for the shell 215, the sheath 216, and/or cap 218 can allow for a relatively high transmission of x-rays 19 out into regions outside the x-ray source 210, 260, or 270 where such x-rays can be useful (e.g. for electrostatic dissipation). At x-ray 19 energy of 10 keV, the shell 215, the shell 215 and the sheath 216 combined, and/or the cap 218 can have x-ray transmissivity of greater than 40% in one aspect, greater than 45% in another aspect, greater than 50% in another aspect, greater than 60% in another aspect, or greater than 70% in another aspect. The x-ray 19 energy just described refers to energy of electrons 18 hitting a target material, energy of x-rays 19 emitted from the x-ray tube 225, and a bias voltage between the cathode 214 and the anode 212. For example, a 10 kV bias voltage between the cathode 214 and the anode 212 can result in 10 keV electrons 18 hitting the target and 10 keV x-rays 19 emitting from the x-ray tube 225.

In order to allow high x-ray 19 transmissivity, low atomic number materials can be selected. For example, a maximum atomic number of any or all material of the shell 215, the sheath 216, and/or the cap 218 can be 8 in one aspect or 16 in another aspect. Materials with a relatively large mass percent of carbon can be useful due to the low atomic number of carbon (6). Beryllium is also useful due to its low atomic number of 4, but beryllium can be expensive and hazardous.

It can be important for the shell 215 to be strong or durable to protect the x-ray tube 225 from damage and to provide sufficient mechanical strength (e.g. for lifting a flat panel display). The shell 215 and the x-ray tube 225 can be tube-shaped for ease of manufacturing and improved strength.

The shell 215 can include or can be made substantially or entirely of a composite material. Some composite materials can be strong and can also have relatively high x-ray 19 transmissivity and/or relatively high electrical conductivity. The term "composite material" typically refers to a material that is made from at least two materials that have significantly different properties from each other, and when combined, the resulting composite material can have different properties than the individual component materials. Composite materials typically include a reinforcing material embedded in a matrix. Typical matrix materials include polymers, bismaleimide, amorphous carbon, hydrogenated amorphous carbon, ceramic, silicon nitride, boron nitride, boron carbide, and aluminum nitride.

The shell 215 can include or can be made substantially or entirely of a carbon fiber composite material. Electrical conductivity of the shell 215 can be improved by a relatively high percent of carbon fibers. For example, the shell 215 can include at least 60% volumetric percent carbon fibers in one aspect, at least 70% volumetric percent carbon fibers in another aspect, or at least 90% volumetric percent carbon fibers in another aspect.

An electrically-insulative material 217 can be disposed between the cathode 214 and the shell 215 to insulate the cathode 214, which will typically be maintained at a large negative voltage (e.g. negative 5-20 kV), from the shell 215, which will typically be maintained at a more positive voltage (e.g. ground). Examples of electrical resistivity of the electrically-insulative material 217 are greater than $1\times10^{12}$ ohm*m in one aspect or greater than $7\times10^{12}$ ohm*m in another aspect. It can also be beneficial for the electrically-insulative material 217 to have a relatively high thermal conductivity in order to allow heat transfer away from the x-ray tube 225. For example, the electrically-insulative material 217 can have a thermal conductivity of greater than $$0.7\frac{w}{m*K}.$$

Emerson and Cuming SYYCASE 2850, with thermal conductivity of about $$1.02\frac{w}{m*K}$$

and electrical resistivity of about $1\times10^{13}$ ohm*m, is one example of an electrically-insulative material 217.

The x-ray sources 210, 260, and 270 can be configured to or can be capable of electrostatic dissipation. For example, the x-ray source 210, 260, and 270 can be operated at a relatively low voltage and/or can emit x-rays 19 across a broad angle (instead of a narrow x-ray beam). As an example of relatively low voltage, the power supply 219 can be configured to or capable of providing a voltage between the cathode 214 and the anode 212 that is at least 1 kilovolt but no greater than 21 kilovolts. A broad angle of x-ray 19 emission, as shown in FIGS. 15, 18, 20, & 21, can be accomplished by disposing an electron emitter 224 portion of the cathode 214 relatively close to the anode 212.

The anode 212 can include a dome-shape 262 for a broad angle of x-ray 19 emission. As shown in FIG. 21, the electron emitter 224 can be disposed within or inside of the dome-shape 262. In one embodiment, the anode 212 with a dome-shape 262 can be made of beryllium. The dome-shape 262 can be made by pressing or forming the material (e.g. beryllium) into the dome-shape 262 or by obtaining a sheet of material and machining out the dome-shape 262. The sheet can have about the same thickness as the final dome thickness Th. The sheet can be a single material (i.e. isotropic material characteristics in all directions). Use of a single material can avoid separation of different layers of materials. The anode 212 with a dome-shape 262 can be made of a composite material, such as for example carbon fiber composite, but maintaining a vacuum within the x-ray tube 225 might be difficult due to outgassing of the composite material.

Method of Electrostatic Dissipation

The x-ray sources described above can be beneficial for electrostatic dissipation due to their relatively low cost, robustness, and/or wide angle beam of x-rays 19. A method of electrostatic dissipation can comprise some or all of the following steps. See FIGS. 8-10 & 13.

Figure 10:
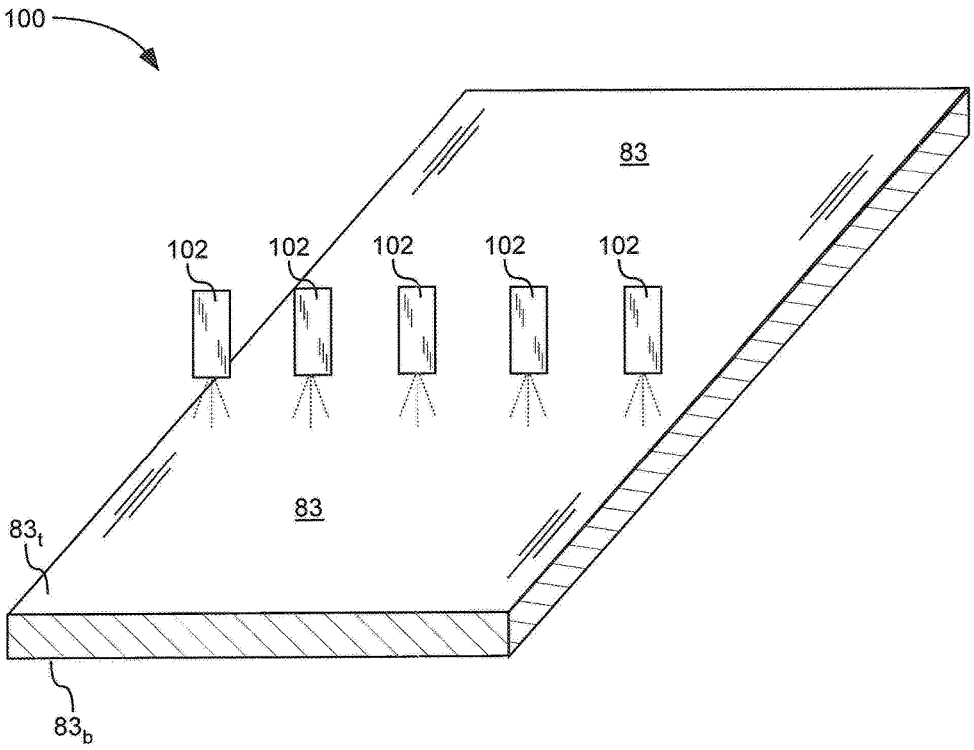
FIG. 10 is a schematic perspective view of a method 100 of using at least one x-ray source 102 to reduce a static, charge on a top side 83, of a flat panel display 83, in accordance with an embodiment of the present invention.
Figure 13:
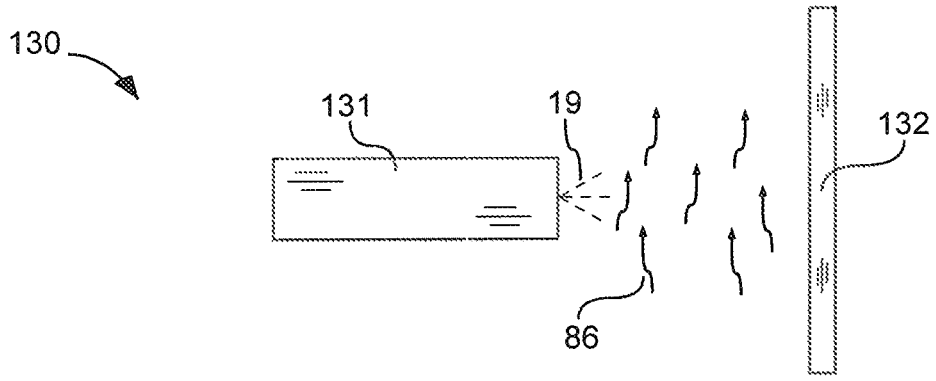
FIG. 13 is a schematic side view of a method 130 of using an x-ray source 131 to ionize particles in a fluid 86. The ions can reduce or dissipate an electrical charge on component 132 or the ions can precipitate out on component 132, in accordance with an embodiment of the present invention.

FIG. 13 is particularly applicable to steps 1-3:

1. Providing at least one of the x-ray sources described above;
2. Emitting x-rays 19 outward from the x-ray source into a fluid 86 and ionizing particles in the fluid 86;
3. Using ions in the fluid 86 to reduce a static charge on a component 132;

FIGS. 8-10 are particularly applicable to steps 4-5:

4. Associating the x-ray source with a lift pin 82, the lift pin 82 configured to apply force against a flat panel display 83 to lift the flat panel display 83 off of a table 84 during manufacture of the flat panel display 83;
5. Emitting x-rays 19 from the x-ray source between the flat panel display 83 and the table 84 while lifting or holding the flat panel display 83 off of the table 84 and wherein the fluid 86 is air between the flat panel display 83 and the table 84 and the component 132 is the flat panel display 83;
6. Causing air to flow between the lift pin 82 and the table 84 to improve the flow of ions in the fluid to the flat panel display 83;

FIGS. 10 & 13 are particularly applicable to steps 7-8:

7. Disposing the x-ray source above a top side 83$_t$ of a flat panel display 83 during manufacture, of the flat panel display 83; and
8. Directing x-rays 19 from the x-ray source towards the top side 83$_t$ of the flat panel display 83 and wherein the fluid 86 is air above the flat panel display 83 and the component 132 is the flat panel display 83.

Note that in step 6 above, a fan or other source of forced air can cause the flow of air. The air flow typically would be from a base of the lift pin 82 (closer to the actuator 81) towards the flat panel display 83.

Method of Electrostatic Precipitation

The x-ray sources described above can be beneficial for electrostatic precipitation due to their relatively low cost, robustness, and/or wide angle beam of x-rays 19. A method of electrostatic precipitation can comprise some or all of the following steps (see FIG. 13):

1. Providing at least of the x-ray sources described above:
2. Emitting x-rays 19 outward from the x-ray source 131 into a fluid 86 to ionize particles in the fluid 86; and
3. Using an electrically charged surface (e.g., by providing an electrical charge to component 132) to precipitate out the ionized particles.

What is claimed is:

1. An x-ray source comprising:
a) an enclosure including an internal cavity;
b) an anode and a cathode attached to the enclosure, the anode and the cathode:
i) being electrically-conductive;
ii) spaced apart from each other; and
iii) electrically insulated from each other;
c) an axis of the enclosure extending from the cathode to a target material of the anode, the target material, configured to emit x-rays in response to impinging electrons from the cathode;
d) a distal free-end of the cathode having an elongated blade, the elongated blade:
i) having a length of at least 10 centimeters;
ii) oriented substantially transverse with respect to the axis of the enclosure;
iii) the elongated blade disposed within the cavity and directed towards the anode with a gap between the blade and the anode; and
e) an electrically-conductive window:
i) associated with and connected to the anode;
ii) being substantially transmissive to x-rays;
iii) forming at least part of a wall of the enclosure; and
iv) separating at least a portion of the cavity from an exterior of the enclosure.

2. The x-ray source of claim 1, wherein the blade has the length of at least 80 centimeters.

3. The x-ray source of claim 1, further comprising:
a) a power supply electrically connected to the anode and the cathode;
b) the power supply configured to provide pulses of voltage between the anode and the cathode having a magnitude sufficiently high to cause periodic arcs between the cathode and the anode; and
c) electrons in the arc, impinging on the anode, cause an emission of x-rays outward from the x-ray source.

4. An x-ray source comprising:
a) an enclosure including an internal cavity;
b) an anode and an electron emitter attached to the enclosure;
c) the anode and the electron emitter being spaced apart from each other and electrically insulated from each other;
d) a window:
i) including an annular-shape;
ii) being electrically-conductive;
iii) being substantially transmissive to x-rays; and
iv) separating at least a portion of the cavity from an exterior of the enclosure;
e) the electron emitter configured to emit electrons towards the anode;
f) the anode including a half-ball-shape having a convex portion extending into the cavity, the convex portion including a target material configured to emit x-rays in response to impinging electrons from the electron emitter.

5. The x-ray source of claim 4, wherein the convex portion of the anode extends into a hollow of the annular-shape of the window.

6. The x-ray source of claim 4, wherein the half-ball-shape of the anode is a single half-ball-shape without a matching half-ball shape.

7. The x-ray source of claim 4, wherein the anode including the half-ball-shape comprises a metal boride, a metal carbon nitride, or combinations thereof.

8. The x-ray source of claim 4, wherein the x-ray source is configured to emit x-rays in a 360° circle outward from the x-ray source.

9. The x-ray source of claim 4, wherein the window comprises carbon fiber composite.

10. The x-ray source of claim 4, wherein the window comprises graphite, plastic, glass, or combinations thereof.

11. The x-ray source of claim 4, wherein the window comprises beryllium.

12. The x-ray source of claim 4, wherein the window comprises boron carbide.

13. The x-ray source of claim 4, wherein the window comprises tungsten.

14. The method of claim 4, further comprising;
a) associating the x-ray source with a lift pin, the lift pin configured to apply force against a flat panel display to lift the flat panel display off of a table during manufacture of the flat panel display; and
b) emitting x-rays from the x-ray source between the flat panel display and the table while lifting or holding the flat panel display off of the table.

15. An x-ray source comprising:
a) an enclosure including an internal cavity;
b) an electron emitter and an anode electrically insulated from each other and attached to the enclosure;
c) the anode having a dome shape with a concave side facing the electron emitter and the internal cavity of the enclosure, the concave side including a target material configured to emit x-rays in response to impinging electrons from the electron emitter;
d) associating the x-ray source with a lift pin, the lift pin configured to apply force against a flat panel display to lift the flat panel display off of a table during manufacture of the flat panel display; and
e) emitting x-rays from the x-ray source between the flat panel display and the table while lifting or holding the flat panel display off of the table.

16. The x-ray source of claim 15, wherein the electron emitter is disposed inside of the dome shape.

17. The x-ray source of claim 15, wherein the anode having the dome shape comprises beryllium.

18. The x-ray source of claim 15, wherein the anode having the dome shape comprises a composite material.

19. The x-ray source of claim 18, wherein the anode having the dome shape comprises carbon fiber composite.

20. The x-ray source of claim 15, wherein the anode having the dome shape comprises a sheet of a single material.

* * * * *